US006889514B2

(12) United States Patent
Lane et al.

(10) Patent No.: US 6,889,514 B2
(45) Date of Patent: May 10, 2005

(54) SERVICE CASE

(75) Inventors: Mark Lane, Acworth, GA (US); Michael B. Davidson, Mississauga (CA); Yakov Arshansky, Conyers, GA (US); David K. Hinde, Rex, GA (US); Richard N. Walker, Monroe, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 9 days.

(21) Appl. No.: 10/465,766

(22) Filed: Jun. 18, 2003

(65) Prior Publication Data

US 2003/0213260 A1 Nov. 20, 2003

Related U.S. Application Data

(62) Division of application No. 10/223,760, filed on Aug. 19, 2002.
(60) Provisional application No. 60/314,196, filed on Aug. 22, 2001.

(51) Int. Cl.[7] ..... A47F 3/04
(52) U.S. Cl. ..... 62/246; 62/234
(58) Field of Search ..... 62/524, 246, 234, 62/157, 251, 434, 256, 255

(56) References Cited

U.S. PATENT DOCUMENTS

| | | | | |
|---|---|---|---|---|
| 1,594,653 | A | 8/1926 | Anstey | |
| 1,691,706 | A | 11/1928 | Daemicke | |
| 1,721,145 | A | 7/1929 | Bromann | |
| 1,863,427 | A | 6/1932 | Warren | |
| 1,896,693 | A | 2/1933 | Battista | |
| 2,136,232 | A | 11/1938 | Bromann, Jr. | 62/89.5 |
| 2,181,635 | A | 11/1939 | Tull | 62/89.5 |
| 2,181,636 | A | 11/1939 | Saunders | 62/89.5 |
| 2,181,637 | A | 11/1939 | Ardito | 62/89.5 |
| 2,209,690 | A | 7/1940 | Fraser | 62/89.6 |
| 2,214,239 | A | 9/1940 | Young | 62/89.5 |
| 2,225,655 | A | 12/1940 | Ottenheimer | 40/130 |
| 2,279,484 | A | 4/1942 | Munshower | 62/89.5 |
| 2,328,189 | A | 8/1943 | Brace et al. | 62/99 |
| 2,379,885 | A | 7/1945 | Davis | 62/89.5 |
| 2,382,599 | A | 8/1945 | Blair | 62/89.5 |
| 2,425,473 | A | 8/1947 | Hoffman | 62/89.5 |
| 2,444,593 | A | 7/1948 | Davis | 62/6 |
| 2,477,393 | A | 7/1949 | Skoog et al. | 62/89.5 |
| 2,495,327 | A | 1/1950 | Hardin | 62/89.6 |

(Continued)

FOREIGN PATENT DOCUMENTS

| | | | |
|---|---|---|---|
| DE | DT 25 05 390 A1 | 8/1976 | A47F/3/04 |
| EP | 0 701 097 B1 | 5/1998 | F25D/25/02 |
| EP | 1066780 A2 * | 1/2001 | |
| GB | 2 185 561 A | 7/1987 | A47F/3/04 |
| JP | 2000-274935 A | 10/2000 | F25D/25/02 |

*Primary Examiner*—William E. Tapolcai
*Assistant Examiner*—Mohammad M. Ali
(74) *Attorney, Agent, or Firm*—Foley & Lardner LLP

(57) ABSTRACT

A temperature controlled service case for storage and display of chilled or frozen products, including at least one compartment for product storage, at least one access opening providing entrance to the compartment, at least one shelf within the compartment for holding product, and refrigeration operatively associated with the compartment for maintaining a selected temperature therein. The refrigeration includes at least one cooling coil above the shelf with a cooling medium flowing therethrough, and cooling within the shelf with a cooling medium flowing therethrough. Coolant supply is also provided for supplying cooling medium to the cooling coil and shelf with separate coolant supply and discharge lines from the coolant supply to the cooling coil and shelf. In accordance with a further embodiment, the shelf is divided into separate sections. In accordance with a still further embodiment, means are provided to warm the coolant for at least one of said cooling coil and shelf.

27 Claims, 6 Drawing Sheets

U.S. PATENT DOCUMENTS

| | | | | | |
|---|---|---|---|---|---|
| 2,513,675 | A | | 7/1950 | Quillen | 62/89.5 |
| 2,607,204 | A | | 8/1952 | Kleist | 62/116 |
| 2,660,864 | A | | 12/1953 | Morris | 62/89.5 |
| 2,663,159 | A | | 12/1953 | Ullstrand | 62/95 |
| 2,690,650 | A | | 10/1954 | Pichler | 62/89.5 |
| 2,732,689 | A | | 1/1956 | Shreve | 62/89.5 |
| 2,932,955 | A | | 4/1960 | Hargrave et al | 62/255 |
| 2,962,874 | A | | 12/1960 | Fitzgerald | 62/251 |
| 2,973,631 | A | | 3/1961 | Adkins | 62/246 |
| 3,056,274 | A | | 10/1962 | Pouchert | 62/418 |
| 3,230,732 | A | | 1/1966 | Rutishauser et al. | 62/255 |
| 3,254,502 | A | | 6/1966 | Ellis | 62/257 |
| 3,561,230 | A | | 2/1971 | Gatton et al. | 62/256 |
| 3,677,025 | A | | 7/1972 | Payne | 62/81 |
| 3,730,603 | A | | 5/1973 | Looms | 312/116 |
| 3,850,486 | A | | 11/1974 | Saxe | 312/116 |
| 3,898,864 | A | | 8/1975 | Steelman | 62/272 |
| 3,937,033 | A | | 2/1976 | Beckwith et al. | 62/155 |
| 3,978,684 | A | | 9/1976 | Taylor | 62/324 |
| 4,135,369 | A | | 1/1979 | Allgeyer et al. | 62/251 |
| 4,265,092 | A | | 5/1981 | Abraham | 62/155 |
| 4,361,012 | A | | 11/1982 | Ibrahim | 62/82 |
| 4,369,631 | A | | 1/1983 | Abraham | 62/82 |
| 4,369,632 | A | | 1/1983 | Abraham | 62/82 |
| 4,370,867 | A | | 2/1983 | Ibrahim | 62/256 |
| 4,375,155 | A | | 3/1983 | Rosanio et al. | 62/256 |
| 4,404,816 | A | | 9/1983 | Ibrahim et al. | 62/282 |
| 4,457,139 | A | * | 7/1984 | Ibrahim | 62/256 |
| 4,478,047 | A | | 10/1984 | Ibrahim | 62/82 |
| 4,514,988 | A | | 5/1985 | Ibrahim | 62/82 |
| RE31,909 | E | | 6/1985 | Ibrahim | 62/82 |
| 4,523,439 | A | | 6/1985 | Denisot | 62/251 |
| 4,535,603 | A | | 8/1985 | Willitts et al. | 62/196.4 |
| 4,565,070 | A | | 1/1986 | Raymond | 62/81 |
| 4,738,120 | A | * | 4/1988 | Lin | 62/272 |
| 4,750,335 | A | | 6/1988 | Wallace et al. | 62/248 |
| 4,938,034 | A | | 7/1990 | Rosanio et al. | 62/256 |
| 4,977,754 | A | | 12/1990 | Upton et al. | 62/248 |
| 4,979,371 | A | | 12/1990 | Larson | 62/81 |
| 4,993,233 | A | | 2/1991 | Borton et al. | 62/155 |
| RE33,620 | E | | 6/1991 | Persem | 62/215 |
| 5,048,303 | A | | 9/1991 | Campbell et al. | 62/256 |
| 5,277,486 | A | | 1/1994 | Bustos | 312/125 |
| 5,315,837 | A | | 5/1994 | Lego | 62/89 |
| 5,323,621 | A | | 6/1994 | Subera et al. | 62/196.4 |
| 5,347,827 | A | | 9/1994 | Rudick et al. | 62/440 |
| 5,475,988 | A | | 12/1995 | McGovern | 62/256 |
| 5,508,898 | A | | 4/1996 | McGovern | 362/92 |
| 5,596,878 | A | | 1/1997 | Hanson et al. | 62/160 |
| 5,598,886 | A | | 2/1997 | Craido-Mellado | 165/254 |
| 5,606,863 | A | | 3/1997 | Kicklighter et al. | 62/89 |
| 5,626,028 | A | | 5/1997 | Graat et al. | 62/252 |
| 5,649,432 | A | | 7/1997 | Cavalea, III | 62/457.1 |
| 5,675,983 | A | | 10/1997 | Ibrahim | 62/255 |
| 5,722,254 | A | | 3/1998 | Roth et al. | 62/457.9 |
| 5,727,393 | A | | 3/1998 | Mahmoudzadeh | 62/81 |
| 5,743,098 | A | | 4/1998 | Behr | 62/80 |
| 5,743,102 | A | | 4/1998 | Thomas et al. | 62/185 |
| 5,755,108 | A | | 5/1998 | Ibrahim et al. | 62/256 |
| 5,887,440 | A | | 3/1999 | Dube | 62/82 |
| 5,921,092 | A | * | 7/1999 | Behr et al. | 62/81 |
| 5,924,297 | A | | 7/1999 | Wolff et al. | 62/152 |
| D413,459 | S | | 9/1999 | Evdokimoff | D6/472 |
| 5,964,512 | A | | 10/1999 | Borgen | 312/116 |
| 5,970,734 | A | * | 10/1999 | Stillwell et al. | 62/235 |
| 6,089,033 | A | | 7/2000 | Dubë | 62/156 |
| 6,094,925 | A | * | 8/2000 | Arshansky et al. | 62/81 |
| 6,155,075 | A | | 12/2000 | Hanson et al. | 62/512 |
| 6,170,270 | B1 | * | 1/2001 | Arshansky et al. | 62/81 |
| RE37,054 | E | | 2/2001 | Sherwood | 62/246 |
| 6,185,951 | B1 | * | 2/2001 | Lane et al. | 62/246 |
| 6,196,007 | B1 | | 3/2001 | Schlosser et al. | 62/73 |
| 6,202,425 | B1 | | 3/2001 | Arshansky et al. | 62/119 |
| 6,205,795 | B1 | * | 3/2001 | Backman et al. | 62/79 |
| 6,272,876 | B1 | | 8/2001 | Roberts et al. | 62/255 |
| 6,311,512 | B1 | | 11/2001 | Fung et al. | 62/272 |
| 6,360,548 | B1 | | 3/2002 | Navarro | 62/93 |
| 6,379,240 | B2 | * | 4/2002 | Livchak et al. | 454/193 |
| 6,381,976 | B1 | | 5/2002 | Kempiak et al. | 62/255 |
| 6,393,768 | B1 | | 5/2002 | Roche et al. | 49/506 |
| 6,401,399 | B1 | | 6/2002 | Roche et al. | 49/501 |
| 6,427,468 | B1 | | 8/2002 | Topper et al. | 62/272 |
| 6,438,983 | B1 | | 8/2002 | Zellner et al. | 62/246 |
| 6,449,967 | B1 | | 9/2002 | Dubë | 62/156 |
| 6,460,372 | B1 | | 10/2002 | Fung et al. | 62/515 |
| 6,467,279 | B1 | | 10/2002 | Backman et al. | 62/79 |
| 6,467,282 | B1 | | 10/2002 | French et al. | 62/140 |
| 6,467,294 | B1 | | 10/2002 | Walker et al. | 62/255 |
| 6,502,412 | B1 | | 1/2003 | Dubé | 62/175 |
| 6,519,962 | B1 | | 2/2003 | Schuetter | 62/255 |
| 6,539,741 | B2 | | 4/2003 | Navarro | 62/256 |
| 6,547,346 | B2 | | 4/2003 | Topper et al. | 312/116 |
| 6,619,052 | B1 | | 9/2003 | Nash, Jr. | 62/89 |
| 6,629,422 | B2 | | 10/2003 | Wellman | 62/155 |
| 6,647,735 | B2 | | 11/2003 | Street et al. | 62/132 |
| 6,672,086 | B2 | | 1/2004 | Zangari et al. | 62/156 |
| 6,672,087 | B1 | | 1/2004 | Taras et al. | 62/173 |
| 6,684,650 | B2 | | 2/2004 | Weyna et al. | 62/151 |
| 6,705,093 | B1 | | 3/2004 | Taras et al. | 62/90 |
| 6,722,149 | B1 | | 4/2004 | Saroka et al. | 62/256 |
| 6,745,588 | B2 | | 6/2004 | Kahler | 62/246 |
| 2001/0042383 | A1 | | 11/2001 | Chiang et al. | 62/246 |
| 2002/0163436 | A1 | | 11/2002 | Singh et al. | 340/584 |
| 2002/0184904 | A1 | | 12/2002 | Wellman | 62/186 |
| 2003/0230095 | A1 | | 12/2003 | Kahler | 62/155 |
| 2004/0003601 | A1 | | 1/2004 | Dube | 62/81 |
| 2004/0067290 | A1 | | 4/2004 | Swofford et al. | 426/335 |
| 2004/0069002 | A1 | | 4/2004 | Chuang et al. | 62/256 |
| 2004/0088069 | A1 | | 5/2004 | Singh | 700/108 |

* cited by examiner

SERVICE CASE

CROSS REFERENCE TO RELATED APPLICATION(S)

This application claims the benefit of U.S. Provisional Application Ser. No. 60/314,196, filed Aug. 22, 2001; and is a Division of application Ser. No. 10/223,760, filed Aug. 19, 2002.

BACKGROUND OF THE INVENTION

The present invention relates to a temperature controlled case for storage and display of chilled and/or frozen products, especially in a store environment.

A typical cooling coil in a refrigerated case is constructed of metal, such as copper or aluminum. Since this material is metal, it is quite noticeable when mounted in a refrigerated case. Case manufacturers try to conceal this coil by placing an attractive cover over the coil or placing the coil in a hidden location, as under the product shelf. However, although these methods hide the coil, they do not make the case particularly attractive and may affect refrigeration efficiency.

Refrigeration case shelving is generally made from painted metal or stainless steel. This type of shelving may be used to cover a forced air evaporator mounted beneath the shelf, or there may be a gravity feed coil mounted above the shelving. However, the main purpose of the shelving is to hold and display the product within the refrigerated case. Therefore, in both of the foregoing applications, the actual cooling of the product is achieved from the gravity feed coil mounted above the shelf or from the forced air coil mounted below the shelf, which is not entirely satisfactory.

Therefore, it is a principal object of the present invention to provide an improved, temperature controlled case for storage and display of cooled and/or frozen products.

It is a further object of the present invention to provide a case as aforesaid which is efficient and at the same time esthetically pleasing.

It is an additional object of the present invention to provide a case as aforesaid which may be readily and effectively used in a commercial store environment.

It is a further object of the present invention to provide a coolant service case with coolant means above and below product storage.

It is a still further object of the present invention to provide a coolant service case as aforesaid with coolant means above the product and coolant means beneath the product, including coolant gravity coils and gravity louvers above the product and refrigerated pans beneath the product.

Further objects and advantages of the present invention will appear hereinbelow.

SUMMARY OF THE INVENTION

In accordance with the present invention, the foregoing objects and advantages are readily obtained.

The present invention provides a temperature controlled case for storage and display of chilled and/or frozen products. The coolant service case of the present invention includes at least one cooling coil above the product and a cooling shelf beneath the product, including separate coolant supply and discharge lines from a coolant supply means to the cooling coil and shelf. The coolant coils above the product desirably includes coolant gravity coils and gravity louvers with drains and preferably lighting included therein.

In accordance with one embodiment, the coolant shelf beneath the product includes separate cooling sections for holding product. In accordance with a further embodiment, the shelf is divided into separate sections. In accordance with a still further embodiment, means are provided to warm the coolant for at least one of said cooling coil and shelf.

Further features and advantages of the present invention will appear hereinbelow.

BRIEF DESCRIPTION OF THE DRAWINGS

The present invention will be more readily understandable from a consideration of the following illustrative drawing, wherein.

DETAILED DESCRIPTION OF PREFERRED EMBODIMENTS

Figure 1:
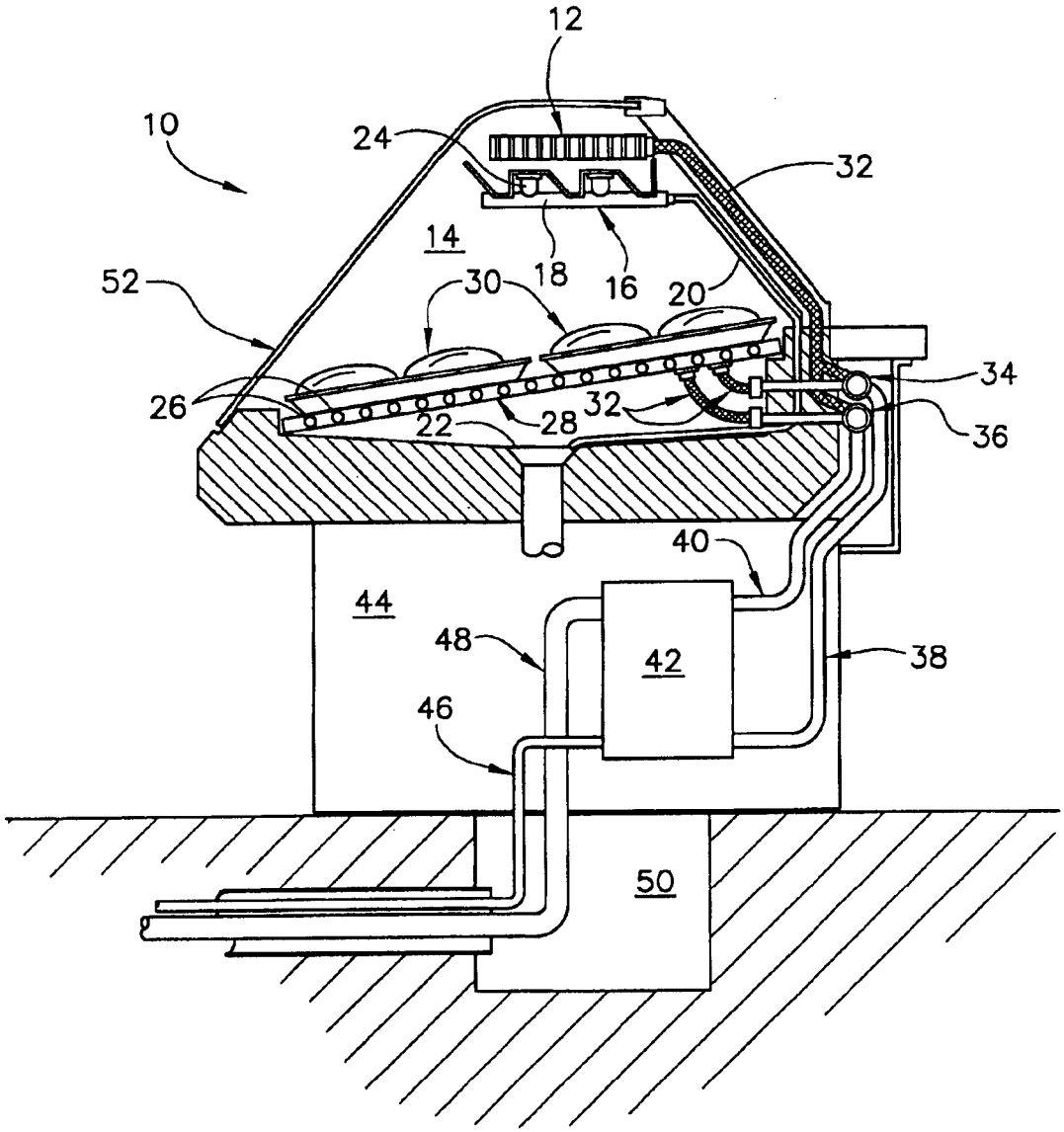
FIG. 1 is a cross-sectional view of a representative coolant service case of the present invention.

FIG. 1 shows a cross-section of a temperature controlled case (10) of the present invention. A secondary coolant gravity coil (12) is situated near the top of the refrigerated space (14). Mounted below the coil is a gravity louver assembly (16) which is designed to both direct air flow through the refrigerated space and catch water falling from the coil above from condensation or melting during defrost cycles. A drain pan (18) directs the flow of water from the louvers (16) into piping (20) connected to the main case drain (22). The louver assembly (16) may also contain an integrated lighting system (24) to better illuminate the product.

Secondary coolant is also circulated through channels (26) inside refrigerated pans or shelf (28) which provide additional cooling. The pans or shelf may be insulated on their underside to prevent heat transfer to the unused space below. Above the pans or shelf, the products (30) are placed in containers, desirably made of a metallic or otherwise heat-conductive material. The secondary coolant flows to and from the cooling coils (12) and to and from the refrigerated shelf or pans inside of flexible hoses (32) which may be equipped with valved quick-disconnect fittings to facilitate removal of the coils or shelf for cleaning or other maintenance.

Supply (34) and return (36) headers for the coolant are placed preferably in the back of the case for connection to the refrigerated coils and shelf. Chilled secondary coolant flows into the supply header (34) through the secondary coolant supply line (38) and coolant flows out of the return header (36) through a secondary coolant return line (40), both of which may either be connected to a packaged chiller (42) or a centralized chiller for multiple cases or the entire facility.

The packaged chiller (42) may consist of a pump to provide flow of coolant and a heat exchanger to provide heat flow from the secondary coolant to a primary coolant, preferably a volatile refrigerant. Additional equipment may also be included to facilitate temperature controls, safety devices, and to provide defrost of the coils and pans.

The chiller (42) is preferably contained within a pedestal base (44) to be hidden from view of the customer. In some situations where a direct expansion system already exists within a store, a refrigerant liquid line (46) and suction line (48) can provide flow of a primary refrigerant to the packaged chiller, possibly through a refrigeration pit (50) already existing in the floor.

In a conventional manner, the coolant service case of the present invention includes an openable door 52 for access to stored products.

In accordance with the present invention, a refrigerated case shelf is provided that is refrigerated by a means of pumping a chilled liquid through the shelf and the shelves are divided into smaller sections for removal and case cleaning. The case selves are supplied a chilled liquid by means of a chilled liquid header system. The header system includes a chilled liquid inlet header and a chilled liquid outlet header. The shelves are connected to the header system via liquid tight connectors that allow the refrigerated shelves to be disconnected from the chilled liquid headers, without losing substantial amounts of the chilled liquid.

Today's case designs use refrigerated coils to cool the case. These coils may be mounted above and below the product shelves. However, it has been found that one single refrigerated shelf or plate has many disadvantages. The plate is generally large and difficult to manufacture. The large plate cannot be readily removed for cleaning bacterial contamination from the case. If the plate is made to be removed, having one single, large plate filled with liquid is not a practical construction. The weight of a single 6–8 foot plate filled with liquid is generally too great for store personnel to remove. Moreover, a single plate design also means that there would be a need for multiple sizes based on the case size. For example, one would need a 4 foot plate for 4 foot cases and an 8 foot plate for 8 foot cases. Typical case sizes include, 4, 6, 8 and 12 foot sizes. The multi-section refrigerated shelf and header design of the present invention overcomes these disadvantages. The manufacturing cost of a multi-shelf header design is greater, but it provides the best means of removing the refrigerated shelves for cleaning, for example, to remove food borne pathogens and bacteria from the case.

Figure 2:
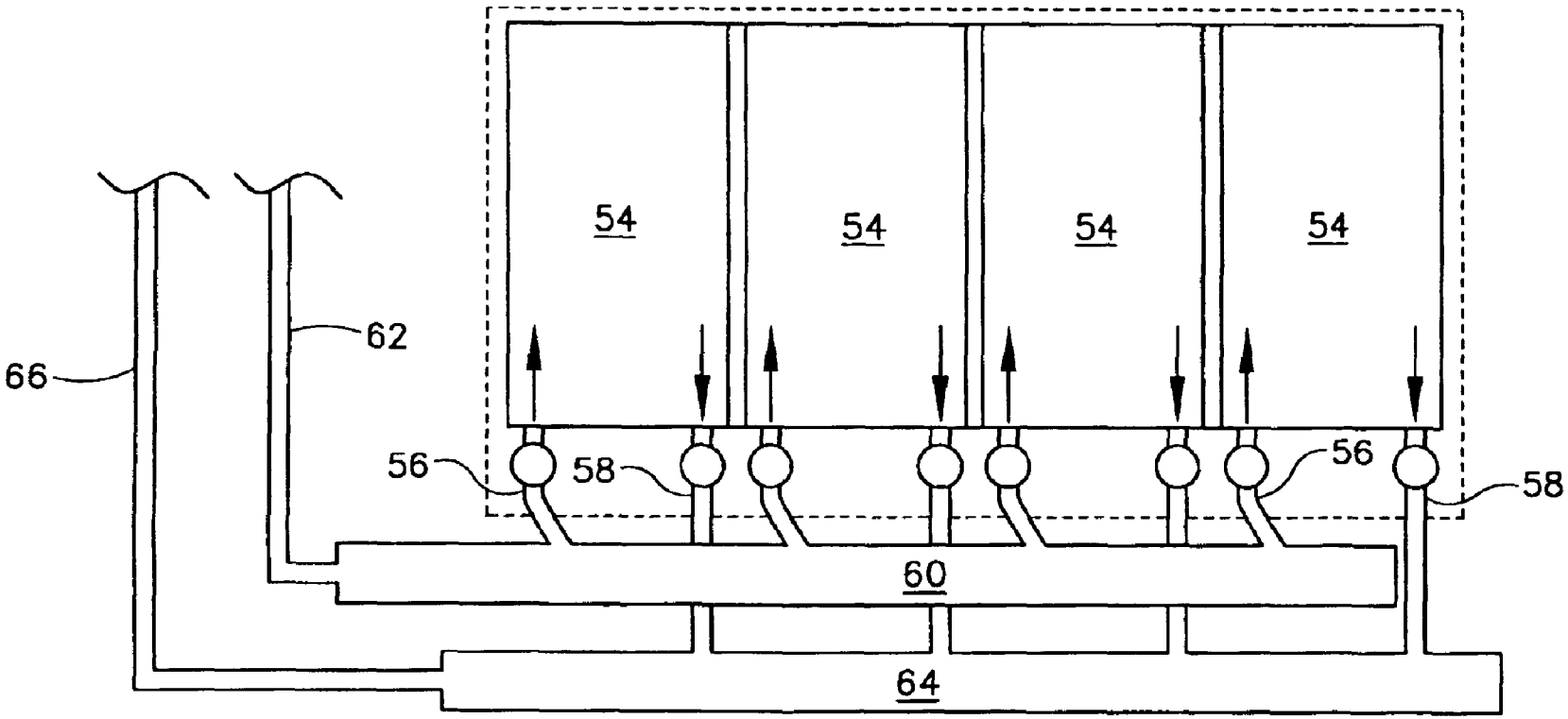
FIG. 2 is a partly schematic view of the inside bottom portion of a coolant service case of the present invention.

FIG. 2 shows the inside bottom of the case for the multi-plate design of the present invention with separate inlets and outlets. Multiple shelves (54) are shown with coolant liquid inlet lines (56) and coolant liquid outlet lines (58). Inlet lines (56) are connected to coolant liquid inlet header (60), which in turn is connected to chilled coolant supply lines (62), and coolant liquid outlet header is connected to coolant liquid outlet header (64), which in turn is connected to coolant outlet supply line (66). The supply lines are connected to a chilled liquid supply (not shown).

Figure 3:
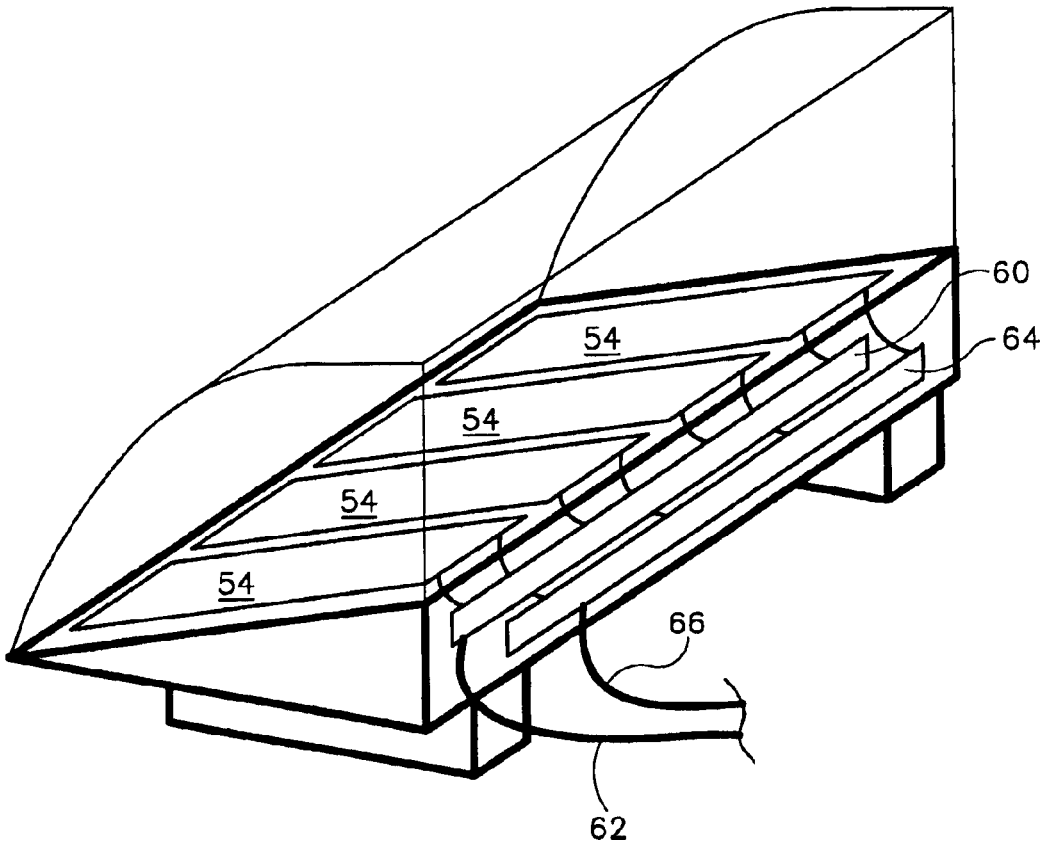
FIG. 3 is a perspective view of a coolant service case of the present invention without the upper coils.
Figure 4:
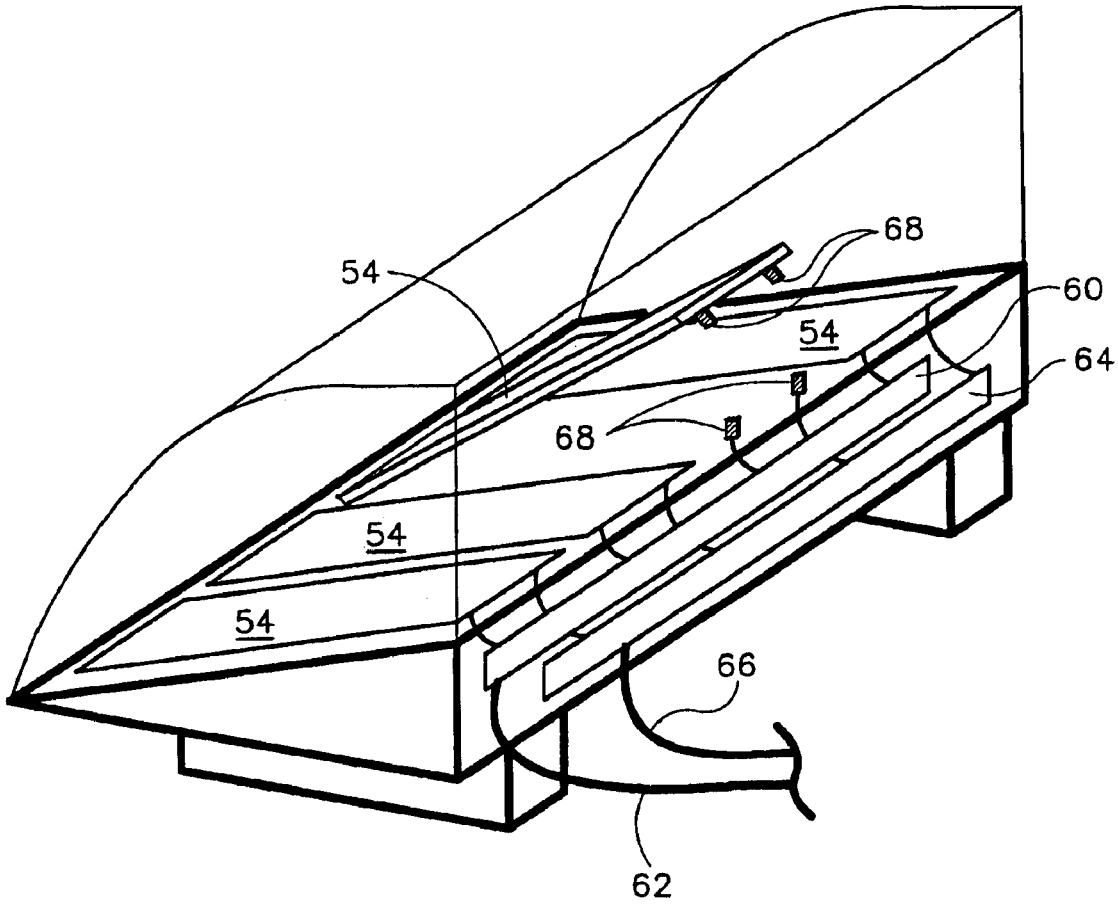
FIG. 4 is a view similar to FIG. 3 showing the removal of one of the sections of the refrigerated shelf.

FIGS. 3–4 show the multi-plate design installed and with the removal of one plate. For convenience, the upper plates are not shown.

FIG. 3 shows the refrigerated shelf with four (4) separate shelf sections, as in FIG. 2.

FIG. 4 shows one of the refrigerated shelf sections disconnected from the chilled liquid headers (60, 64) via the means of low liquid loss connectors (68). The connectors (68) provide an easy means for the store personal to remove the liquid filled shelves without spilling large amounts of the refrigerated liquid. In the above example, the refrigerated shelves are divided into separate sections, as four sections allowing much smaller and lighter sub-sections of shelving.

Figure 5:
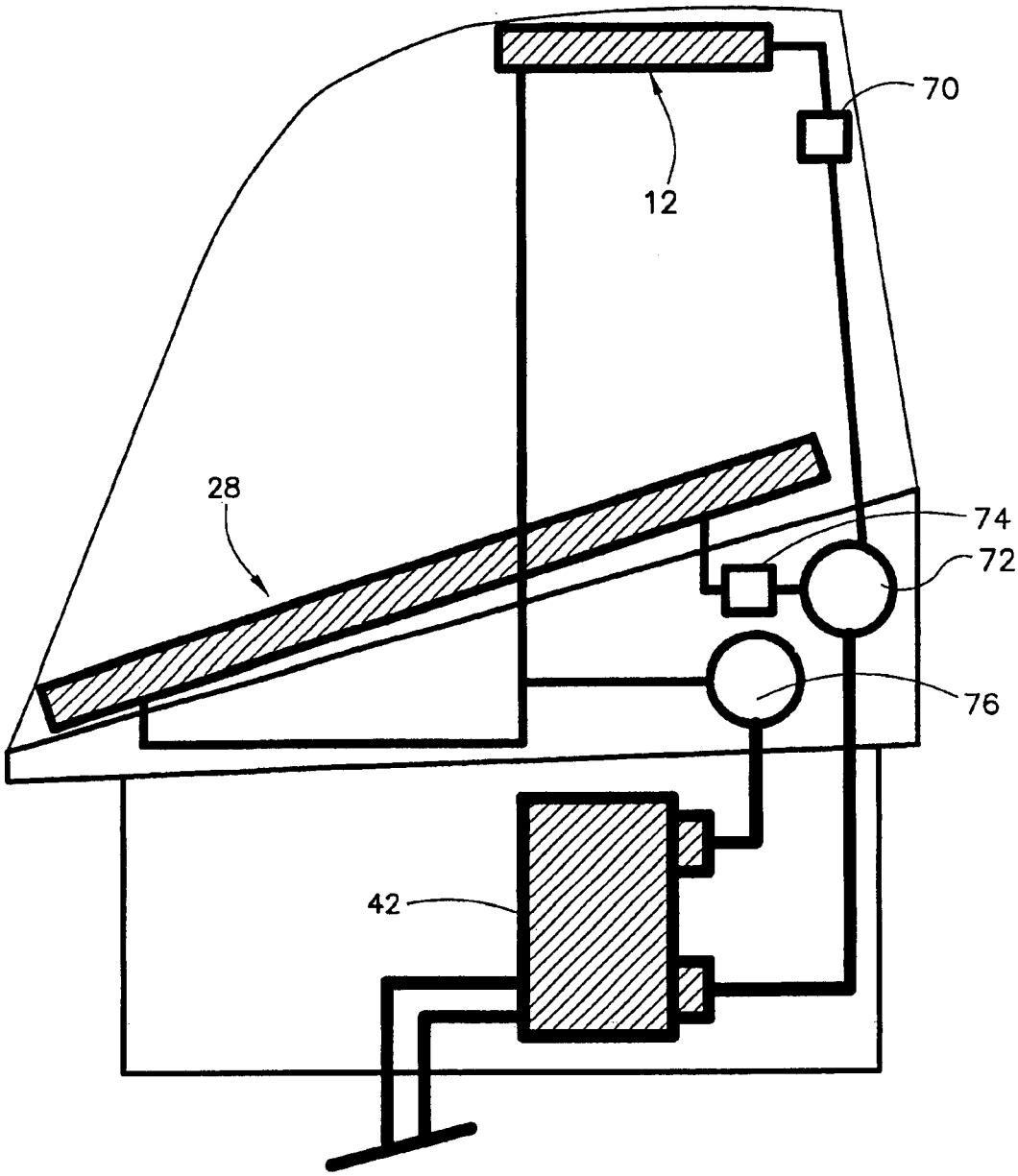
FIG. 5 is a sectional view showing various components of a refrigerated case of the present invention.

The present invention also provides a means of controlling the top coil temperature separately from the refrigerated shelf or pan temperature. This is shown in FIG. 5, which shows a view similar to that shown in FIG. 1. The control may be accomplished by restricting or stopping the flow of chilled liquid to and/or from the top coil (12) or the shelf or pans (28) via a liquid stop solenoid, flow regulator, flow valve, orifice, electronic valve or a change in line size or diameter. When the flow rate is slowed through the shelf or top coil, the temperature will rise, when the flow rate is increased, the temperature decreases. In addition, the present invention provides control of the top coil separately from the bottom coil to increase humidity in the case, and control of the top coil separately from the bottom coil for the purpose of defrosting the top coil or pan at different times and duration.

To control the top coil separately from the bottom shelves, the present invention desirably provides flow regulators (70) installed between the chilled liquid supply header (CLSH) (72) and the top coil (12), then another flow regulator (74) installed between the CLSH (72) and the bottom shelves (28). One of these could be piped directly to the CLSH with only one item having a flow regulator valve installed. This would allow one item, such as the shelves, to be controlled based on the CLSH temperature while the other item, the top coil, may be controlled separately. However, with the shelves being controlled by the CLSH, the CLSH will have to defrost along with the shelves, thus also causing the coil to enter a defrost stage. With separate flow regulating devices, the top coil and shelves can be defrosted separately and the CLSH would never need to defrost. FIG. 5 shows illustration of this system's piping, showing the upper coils (12), shelf (28), flow regulators (70, 74), chilled liquid supply header (72), return header (76) and chiller (42).

During normal operation, it very important that the product temperature be precisely controlled. The case will hold the most expensive product in the supermarket and the most volatile to food borne pathogens, which cause over 6,000 deaths per year in the US. The FDA has mandated that a 41 degree product temperature be maintained at all times to prevent food borne illnesses. Therefore, the dual temperature control of the present invention allows flexible temperature control during normal operation.

When the case is refrigerating, the shelf temperature will be set at the temperature desired for the product. For example, if the product was fresh beef, the shelf temperature would be set at 30 degrees. Because the fresh meat sits directly on the refrigerated shelves, the meat will be held at 30 degrees. Then the coil temperature will be set at 28 degrees to maintain the air temperature in the case. By setting the shelf temperature higher than the coil temperature, a very slow convection cooling effect will happen inside the case, causing very slow air movement over the product.

In addition to controlling the temperature, when cycling the top coil's flow regulator based on the coil's actual temperature, the amount of moisture being removed from the case can be precisely controlled. In a conventional case, the top coil is controlled to maintain product temperature. However, in the case design of the present invention, the product temperature is mostly controlled by controlling the shelf flow regulator. The top coil is now available to be cycled based on the case's air and the coils temperature, which directly affect the case's humidity.

This is a significant case feature, since the product in the case is fresh meat, seafood or any other fresh product that may need to maintain a high moisture level. In the case of fresh beef, the weight, look, and freshness of the beef are mostly determined by the liquid content of the beef. If the top coil has to operate at a very low temperature, as is the case on a conventional case, the coil builds a very high frost level. This frost comes directly from two sources, one being the operating environment, such as the building the case is installed in, and two being from the fresh meat itself. When the fresh meat loses moisture in the form of frost on the top coil, the product loses weight and start to get a very dry look. The weight directly affects the profits from the sales of the meat. The dry look affects the customer's desire to buy the product. Both of which are very negative.

By controlling the top coils temperature exactly, using the top coils flow regulator, design of the present invention will maintain a much higher humidity, keeping more of the moisture in the fresh meat as opposed to turning the moisture into frost on the top coil. Moreover, the reason the top coil can be maintained at a separate and desired temperature level, is that the bottom shelves are controlled to maintain the actual product temperature by cycling the shelf flow regulator.

In a traditional case, the case enters defrost and stops defrosting as one unit. All coils and refrigeration devices enter defrost at the same time. When this happens the case temperature and product temperature rises, until the defrost cycle has ended. Then the product temperature and case temperature is pulled down to the level of normal operation. This momentary rise in product temperature two, three or four times a day, can directly affect the product life, color and bacterial growth. If this product rise happens to often, it can cause a real food safety issue in the case.

With the design of the present invention, one can defrost the top coil while still refrigerating the bottom pans. Next the pans can be defrosted will the top coil is still refrigerating. By defrosting these separately in this fashion, the product is always being cooled by one device, while the frost level is being reduced on the other. Reducing the frost level is a must in all refrigerated applications, in order to maintain case performance and cooling capacity. Since the product is always receiving cooling effect from one device, the product temperature change during a defrost cycle, is very minimal.

In addition to cycling defrost at different times, the defrost times and duration can vary. In this case, the refrigerated shelves or pans are not as affected by frost as the top coil is. Therefore, the top coil can be defrosted more times a day than the bottom pans. By reducing the amount of total defrosts, the product temperature will be better maintained.

Figure 6:
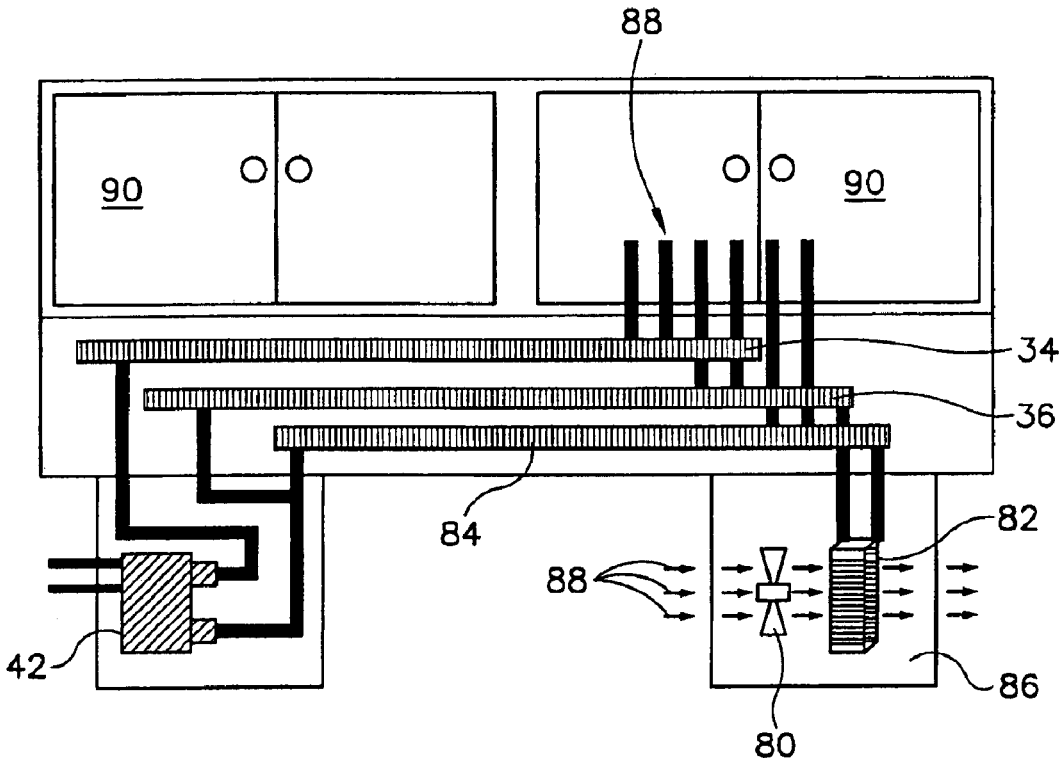
FIG. 6 is a rear view of a refrigerated case of the present invention.

In addition, the present invention provides for the installation of a heat exchanger in the case for the purpose of using store ambient air to generate warm fluid at the case to defrost or temperature control at least one of the top coil and refrigerated pans. This is illustrated in FIG. 6 which shows a rear view of a case of the present invention. In a conventional case, hot gas or an electric heater is used to generate heat in the case to defrost the case coils. These systems are direct expansion systems, using only a refrigerant gas. Since the design of the present invention uses a small secondary cooling loop that pumps a chilled liquid, such as glycol or water, that is much more environmentally friendly, one needs a way to defrost the coils, without a hot gas or electric heater. To generate a warm liquid, the present invention desirably installs a fan (80), coil (82) and a warm liquid defrost header (84).

The case operation for refrigeration will remain the same as previously mentioned, however, during a defrost cycle, the warm liquid will be pumped from the warm liquid defrost header (84) through the top coil or refrigerated pans. The warm liquid will quickly defrost the device, removing all frost from the device.

The use of a small air cooled coil (82), fan (80), header (84) and all associated valves needed to bypass the chilled liquid that is normally sent to the top coil and pans. The chilled liquid will be replaced with the warm fluid, thus causing a rapid thaw of the frost from the top coil and bottom pans.

The warm liquid for defrost could be generated in the above fashion or by using a storage vessel or a small holding tank (86) with heating means, as heating coils (82) or an electric heater. The most economic way to generate the warm liquid would be using the warm or ambient air (88) from the store environment. Also note, if the system does not have a plate heat exchanger at the case, generating warm liquid for defrost using this method would most likely not be used. The warm liquid generation and valves would be in the store's machine room where the plate heat exchanger would be installed.

Thus, referring to FIG. 6, which shows the rear of the present case, chiller (42) is connected to chilled liquid supply header (34) and return header (36) which in turn are connected to piping (88) for the coils and shelves (not shown in FIG. 6). Doors (90) are shown to provide access to the case. Warm liquid defrost header (84) is connected to heating coils (82) as described above.

Alternatively, the means to warm the secondary coolant can be accomplished by means of a ground loop system, where piping is installed in or below the foundation of the building to retrieve heat generated by the earth for the purpose of warming the secondary coolant. As a further alternative, one can warm the secondary coolant by using a solar collector that uses solar energy to heat the secondary coolant. As a still further alternative, one can warm the secondary coolant by using the discharge heat from the primary cooling system for the means of warming the secondary coolant. Still further, one can warm secondary coolant by using heat generated by electric heaters to heat air that is blown across a coil by use of a fan, where the secondary coolant travels through the coil.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A temperature controlled case for use in a store environment for storage and display of chilled or frozen products, which comprises:

at least one compartment for storage of products;

at least one access opening providing entrance to the compartment;

at least one shelf within the compartment for products;

at least one coil above the shelf;

a refrigeration system configured to circulate a coolant to at least one of the shelf and the coil to maintain a selected temperature within the compartment;

a defrost system comprising a heat exchanger configured to warm the coolant for circulation to defrost at least one of the coil and the shelf;

a flow regulation device for controlling a flow rate of the fluid to at least one of the coil and the shelf.

2. The temperature controlled case of claim 1 wherein the refrigeration system further comprises a primary and secondary cooling system, wherein the primary cooling system chills coolant in the secondary cooling system to provide cooling for the case.

3. The temperature controlled case of claim 2 wherein the secondary cooling system circulates coolant to the shelf.

4. The temperature controlled case of claim 1 wherein the coolant is circulated through at least one coolant supply line and at least one coolant discharge line and at least one of the coolant supply line and coolant discharge line comprises the flow regulator device configured to control a temperature of at least one of the coil and the shelf.

5. The temperature controlled case of claim 1 wherein the shelf is divided into separate sections.

6. The temperature controlled case of claim 1 wherein the heat exchanger is configured to use air from the store environment to warm the coolant for defrosting.

7. The temperature controlled case of claim 1 wherein the heat exchanger is configured to warm the coolant by interaction with a storage vessel with heating means.

8. The temperature controlled case of claim 1 wherein the heat exchanger comprises a fan and a coil.

9. The temperature controlled case of claim 4 wherein the flow regulator device comprises at least one of a solenoid valve, a flow valve, an orifice, an electronic valve and a change in a diameter of the coolant supply line or the coolant discharge line.

10. The temperature controlled case of claim 1 further comprising a louver beneath the coil and configured to direct air flow within the compartment.

11. A refrigeration device having a primary cooling system with a primary fluid communicating with a first heat exchanger and a secondary cooling system with a secondary fluid communicating with the first heat exchanger to cool the secondary fluid and communicating with at least one of a cooling coil and a pan configured to provide cooling to a compartment to be cooled in a refrigeration mode of operation, the refrigeration device comprising:

at least one coolant supply line and at least one coolant discharge line configured to circulate the secondary fluid through the at least one cooling device; and a second heat exchanger communicating with the secondary cooling system and communicating with a source of air to warm the secondary fluid in a defrost mode of operation;

wherein the pan is configured to support objects to be cooled within the compartment and the cooling coil disposed above the pan and the objects;

wherein the pan is configured to operate in the refrigeration mode while the cooling coil is configured to operate in the defrost mode.

12. The refrigeration device of claim 11 wherein the second heat exchanger comprises a fan.

13. The refrigeration device of claim 12 wherein a frequency of the defrost mode of operation for the cooling coil is greater than the frequency of the defrost mode of operation for the pan.

14. The refrigeration device of claim 11 wherein the pan is divided into separated sections.

15. The refrigeration device of claim 11 wherein the cooling coil comprises a gravity type coil.

16. The refrigeration device of claim 11 further comprising flexible hoses for routing the secondary fluid to the coil and the pan.

17. The refrigeration device of claim 11 wherein the source of air is an ambient air space in a store.

18. The refrigeration device of claim 11 wherein the pan further comprises an insulation layer on an underside of the pan.

19. A system for refrigeration of products comprising:

a case having a compartment defining a space configured to receive the products;

a first heat exchanger configured to cool a fluid communicating with the space to cool the products;

a second heat exchanger comprising a fan-coil unit configured to interact with an air source to warm the fluid; and at least one coolant device within the compartment and configured to receive the cooled fluid during a refrigerating mode and to receive the warmed fluid during a defrosting mode.

20. The system of claim 19 wherein the air source is an ambient air source in a store.

21. The system of claim 19 wherein the at least one cooling device comprises a shelf disposed in the compartment and a cooling coil disposed above the products.

22. The system of claim 21 wherein a frequency of the defrosting mode of operation for the cooling coil is greater than a frequency of the defrosting mode of operation for the shelf.

23. The system of claim 21 further comprising at least one flow regulating device configured to control the flow of the fluid to at least one of the cooling coil and the shelf.

24. The system of claim 21 wherein the cooling coil is maintained at a first temperature and the shelf is maintained at a second temperature different from the first temperature.

25. The system of claim 19 further comprising flexible hoses configured to route the fluid to the at least one cooling device.

26. The system of claim 19 further comprising a louver assembly configured to direct a flow of air within the space.

27. The system of claim 21 wherein the shelf comprises multiple sections to facilitate removal of the sections.

* * * * *